United States Patent [19]

Muscato

[11] Patent Number: 4,789,024

[45] Date of Patent: Dec. 6, 1988

[54] LOW PROFILE ELEMENT BASKET ASSEMBLY WITH INTEGRAL LIFTING MEANS

[75] Inventor: Lawrence J. Muscato, Bolivar, N.Y.

[73] Assignee: The Air Preheater Company, Inc., Wellsville, N.Y.

[21] Appl. No.: 163,504

[22] Filed: Mar. 3, 1988

[51] Int. Cl.[4] ..... F28D 19/04

[52] U.S. Cl. ..... 165/10; 165/8; 165/906

[58] Field of Search ..... 165/8, 10, 906

*Primary Examiner*—Albert W. Davis, Jr.

*Attorney, Agent, or Firm*—William W. Habelt

[57] ABSTRACT

An element basket assembly (30) for a rotary regenerative heat exchanger (2) comprised of a plurality of heat transfer element plates (32) stacked in an array between first and second end plates (34,36) disposed at opposite ends of the stacked array of heat transfer element plates (32). Upper and lower side straps (40,42 and 50,52) run along opposite sides of the stacked array of heat transfer element plates, to interconnect the first and second end plates (34,36) to form the frame of the element basket housing the heat transfer element plates. A stiffening member (60) is disposed intermediate the spaced end plates (34,36) to extend transversely across the assembled element basket assembly in a plane through the centroid thereof to the interconnect the upper side straps (40,42) and to interconnect the lower side straps (50,52) thereby increasing the structural integrity of the basket assembly. An upper pair of laterally spaced lifting holes (70*a*, 70*b*) in an upper region of the stiffening member (60) and a lower pair of laterally spaced lifting holes (70*c*, 70*d*) in a lower region of the stiffening member (60) are provided to facilitate handling of the assembled element basket (30).

6 Claims, 2 Drawing Sheets

LOW PROFILE ELEMENT BASKET ASSEMBLY WITH INTEGRAL LIFTING MEANS

BACKGROUND OF THE INVENTION

The present invention relates to heat transfer element baskets and, more specifically, to an assembly of heat absorbent plates in a basket for use in a heat exchanger wherein heat is transferred by means of the plates from a hot heat exchange fluid to a cold heat exchange fluid. The present invention has particular application in heat transfer apparatus of the rotary regenerative type wherein the heat transfer element is heated by contact with a hot gaseous heat exchange fluid and thereafter brought in contact with a cool gaseous heat exchange fluid to which the heat transfer element gives up its heat.

One type of heat exchange apparatus commonly used for gas-to-gas heat exchange in the process industry and for gas-to-air heat exchange on utility steam generators is the well-known rotary regenerative heat exchanger. Typically, a rotary regenerative heat exchanger has a cylindrical rotor divided into compartments in which are disposed a mass of heat transfer element which, as the rotor turns, is alternately exposed to a stream of heating gas and then upon rotation of the rotor to a stream of cooler air or other gaseous fluid to be heated. The heat absorbent mass typically comprises a plurality of heat transfer element basket assemblies mounted in sector shaped compartments. Each of the heat transfer element basket assemblies houses a plurality of heat transfer plates which when exposed to the heating gas absorb heat therefrom and then when exposed to the cool air or other gaseous fluid to be heated, the heat absorbed from the heating gas by the heat transfer plates is transferred to the cooler gas.

Typically, such an element basket assembly comprises a pair of spaced end plates held together by paired side straps interconnecting the end plates along the sides thereof such as shown in U.S. Pat. Nos. 3,314,472, 4,561,492 and 4,606,400. A plurality of heat transfer plates are stacked in closely spaced relationship within the basket housing to provide a plurality of passageways between adjacent plates through which the heat exchange fluids pass. The side straps which interconnect the spaced end plates extend in pairs along the opposite sides of the stacked array of heat exchange elements. On each side of the heat exchange element is a first side strap extending between the upper regions of the spaced end plates and a second side strap extending between the lower region of the end plates in spaced, parallel relationship to the first side strap. The side straps may be flanged inwardly along the longitudinal edge lying at the edge of the basket assembly to provide a retaining surface for preventing the heat transfer plates from falling out of the open ends of the element basket as shown in U.S. Pat. No. 3,314,472.

Preferably, one or more retaining bars are welded between the end plates across the top and bottom ends thereof to further assist in keeping the heat transfer element plates from falling out of the open ends of the element basket. The retaining bars may merely be disposed to lie across the top and bottom edges of the heat transfer element plates as shown in U.S. Pat. No. 4,561,492. Alternatively, in order to provide a shorter basket for a given plate height, the retaining bars may be disposed within recesses cut in the top and bottom edges of the heat transfer element plates as shown in U.S. Pat. No. 4,606,400.

The retaining bars also serve as structural members for supporting lifting means to facilitate handling of the assembled element baskets and, in particular, to facilitate the installation and removal of the element baskets from the heat exchanger. Typically, the lifting means comprises a pair of spaced aparted holes formed in a centrally located retaining bar as shown in U.S. Pat. No. 4,552,204, or a pair of spaced aparted pins integral with and passing through a centrally located retaining bar as shown in U.S. Pat. No. 4,557,318. When the lifting means comprises a pair of holes as in the aforementioned U.S. Pat. No. 4,552,204, the element basket is lifted by means of a pair of clevis means which are disposed to spa the central retaining bar about each lifting hole. Each clevis is engaged to the retaining bar by a pin which is passed through the lifting hole and each side of the clevis spanning the bar. When the lifting means comprises a pair of lifting pins as in the aforementioned U.S. Pat. No. 4,557,318, the element basket is lifted by means of a pair of lifting lugs which simply grasp the pins extending through the central retaining bar.

An element basket characterized by its compactness relative to the height element carried therein, known as the Low Profile element basket, is disclosed in commonly assigned, co-pending patent application Ser. No. 84,063, filed Aug. 11, 1987. The element basket assembly disclosed therein comprises a plurality of heat transfer element plates disposed in a stacked array between spaced end plates located at opposite ends of the stacked array of heat transfer element plates and interconnected by spaced upper and lower side straps welded to and extending between the side of the end plates at the upper and lower lateral edges thereof. A stiffening member is disposed within the stacked array of heat transfer element plates to extend transversely across the element basket assembly to interconnect the upper side straps together and to interconnect the lower side straps together thereby providing a structural cross-link between the respective upper and lower side straps whereby the structural integrity of the frame of the element basket assembly is improved. Typically, the stiffening member comprises a single plate-like member disposed within the stacked array of heat transfer plates at or near the mid-span between the end plates of the element basket with the plate-like stiffening member extending from top to bottom and side to side across the cross-section of the element basket assembly. However, the stiffening member may take other forms as discussed in the aforementioned patent application.

As disclosed in the aforementioned commonly-assigned application Ser. No. 84,063, lifting of the compact basket assembly may be facilitated by providing lifting holes in the upper region of the stiffening member for the insertion of a lifting clevis in the manner disclosed in commonly-assigned U.S. Pat. No. 4,552,204. It is an object of the present invention to provide an improved compact element basket assembly having integral lifting means which more readily facilitates handling of the assembled baskets.

SUMMARY OF THE INVENTION

In the compact element basket assembly of the present invention, a plurality of heat transfer element plates are disposed in a stacked array between spaced end plates which are disposed at opposite ends of the stacked array of heat transfer element plates and interconnected by spaced upper and lower side straps welded to and extending between the sides of the end plates at the upper and lower edges thereof. A stiffening member is disposed within the stacked array of heat transfer element plates to extend transversely across the element basket assembly through the centroid of the element basket assembly to interconnect the upper side straps together and to interconnect the lower side straps together thereby providing a structural cross-link between the respective upper and lower side straps whereby the structural integrity of the frame of the element basket assembly is improved. Lifting means are provided integral with the stiffening member disposed to extend through centroid of the element basket assembly for facilitating handling of the element basket assembly.

In one embodiment, the stiffening member disposed to extend through the centroid of the element basket assembly comprises a plate-like member extending from top to bottom and side to side across the cross-section of the element basket assembly, with the plate-like member having formed integrally therein lifting means adapted to be engaged by a lifting hook. Preferably, the lifting means comprises a first pair of laterally spaced holes formed in an upper region of the plate-like member and a second pair f laterally spaced holes formed in a lower region of the plate-like member, the holes adapted to receive a lifting hook.

In an alternate embodiment, the stiffening member disposed to extend through the centroid of the element basket assembly comprises spaced upper and lower plank-like members, the upper member extending transversely across the element basket assembly interconnecting said pair of spaced upper side straps and the lower member extending transversely across the element basket assembly interconnecting said pair of spaced lower side straps, with each plank having formed integrally therein lifting means adapted to be engaged by a lifting hook. The lifting means preferably comprises a first pair of laterally spaced holes formed in the upper member and a second pair of laterally spaced holes formed in the lower member, the holes adapted to receive a lifting hook.

DESCRIPTION OF A PREFERRED EMBODIMENT

Figure 1:
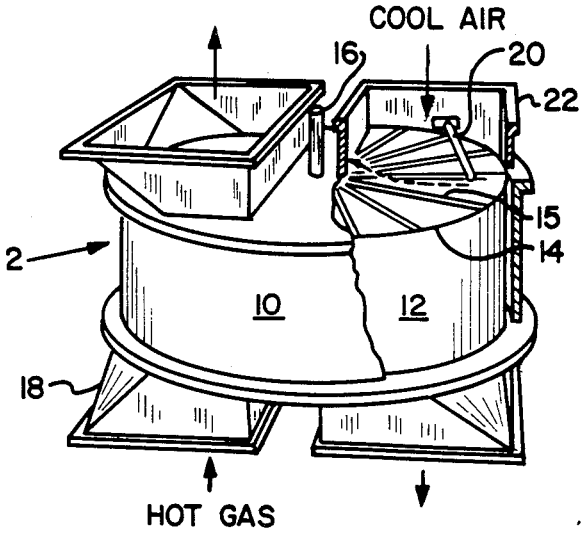
FIG. 1 is a perspective view of a rotary regenerative heat exchanger.
Figure 2:
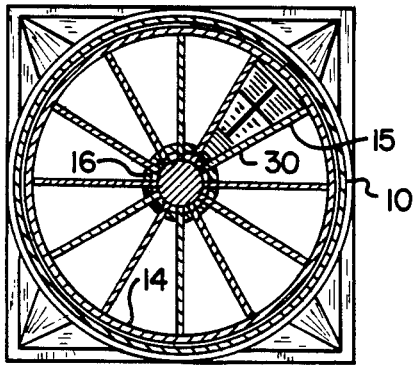
FIG. 2 is a plan view of the rotary regenerative heat exchanger of FIG. 1 taken along line 2—2.

Referring now to the drawings and, more particularly to FIG. 1, there is depicted therein a regenerative heat exchanger apparatus 2 in which the heat transfer element basket assemblies of the present invention may be utilized. The rotary regenerative heat exchanger 2 comprises a housing 10 enclosing a rotor 12 wherein the heat transfer element basket assemblies of the present invention are carried. The rotor 12 comprises a cylindrical shell 14 connected by radially extending diaphragms 15 to the rotor post 16. A heating fluid enters the housing 10 through duct 18 while the fluid to be heated enters the housing 10 from the opposite end thereof through duct 22.

The rotor 12 is turned about its axis by a motor connected to the rotor post 16 through suitable reduction gearing, not illustrated here. As the rotor 12 rotates, the heat transfer element plates carried within the element basket assemblies disposed within the rotor are first moved in contact with the heating fluid entering the housing through duct 18 to absorb heat therefrom and then into contact with the fluid to be heated entering the housing through duct 22. As the heating fluid passes over the heat transfer element plates, the heat transfer element plates absorb heat therefrom. As the fluid to be heated subsequently passes over the heat transfer element plates, the fluid absorbs from the heat transfer element plates the heat which the plates had picked up when in contact with the heating fluid.

Rotary regenerative heat exchangers are often utilized as air preheaters wherein the heat absorbent element serves to transfer heat from the hot flue gases generated in a fossil fuel-fired furnace to ambient air being supplied to the furnace as combustion air as a means of preheating the combustion air and raising overall combustion efficiency. Very often, the flue gas leaving the furnace is laden with particulate generated during the combustion process. This particulate has a tendency to deposit on heat transfer element plates particularly at the cold end of the heat exchanger where condensation of any moisture in the flue gas may occur. In order to provide for periodic cleaning of the heat transfer element disposed within the element basket assemblies, the heat exchanger is provided with a cleaning nozzle 20 disposed in the passage for the fluid to be heated adjacent the cold end of the rotor 12 and opposite the open end of the heat transfer element basket assemblies. The cleaning nozzle 20 directs a high pressure cleaning fluid, typically steam, water, or air, through the plates as they rotate slowly while the nozzle itself sweeps across the end face of the rotor. As the high pressure fluid passes over the heat transfer element plates to vibrate so as to jar loose flyash and other particulate deposits clinging thereto. The loosened particulate is then entrained in the high pressure stream and carried out of the rotor.

The heat exchange material carried in the rotor 12 comprises a mass of metallic heat transfer element plates formed with corrugations or undulations such that when the plates are placed in abutting relationship in a stack array, a series of internal passages are provided through which the heating fluid and cooling fluid flow. The plates are typically assembled in an essentially trapezoidal-shaped frame, termed an element basket, that houses the stacked array of plates with the individual plates held in their stacked order so that they may be handled as an integral assembly for placement within the sector-shaped compartments within the rotor of the heat exchanger.

Figure 3:
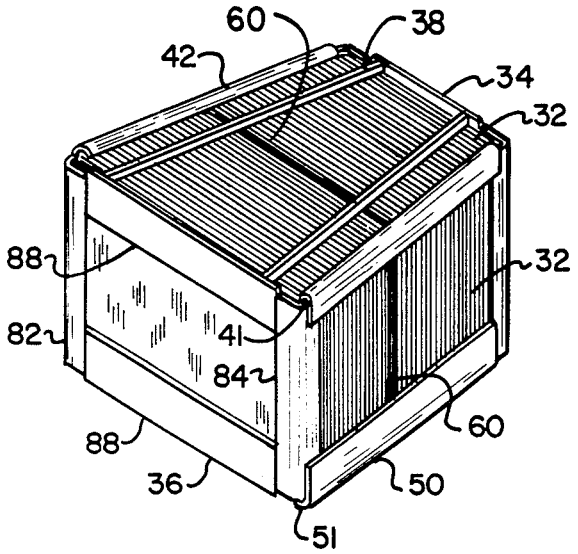
FIG. 3 is a perspective view of an element basket assembly designed in accordance with the present invention.

As illustrated in FIGS. 3 and 4, the element basket assembly 30 of the present invention comprises a plurality of heat transfer element plates 32 juxtaposed in spaced relationship to provide a stacked array of plates having a plurality of flow passages therebetween so as to provide a flow path through which heat exchange fluid may pass in heat exchange relationship with the plates 32. The plates 32 are usually of thin sheet metal capable of being rolled or stamped to a desired configuration, however, the invention is not limited necessarily to the use of metallic plates. The plates 32 may be of various surface configuration such as, but not limited to, a flat surface or a corrugated or undulated surface, or a combination thereof with the flat plates stacked alternately between corrugated or undulated plates. In any case, the stacked array of element plates is disposed between a first end plate 34 at one end thereof and a second end plate 36 at the other end thereof. The end plates 34 and 36 abut the ends of the stacked array of heat transfer element plates and are held in position by means of side straps 40, 42 and 50, 52 which are disposed along opposite sides of the stacked array of heat transfer element plates at the upper and lower edges of the plates, respectively, to interconnect the spaced-apart first and second end plates 34 and 36.

It is to be understood that the end plates 34 and 36 may be, but need not be, full plates. Rather, one or both of the end plates 34 and 36 may be formed of two spaced vertical side members 82 and 84 interconnected by a horizontally disposed transversely extending upper member 86 and a horizontally disposed transversely extending lower member 88. These four members 82, 84, 86 and 88 are welded together at their respective intersections to form a substantially rectangular end plate as best seen in FIG. 3.

The side plates 40 and 42 are welded at one end to the upper right and upper left corners, respectively, of the end plate 34 and are welded at their other end to the upper right and upper left corners of the opposite end plate 36. Similarly, the side plates 50 and 52 are welded at one end to the lower right and lower left corners, respectively, of the end plate 34 and are welded at their other end to the lower right and lower left corners of the opposite end plate 36.

As best seen in FIGS. 3 and 4, the side straps 40, 42, 50 and 52, are preferably flanged along their longitudinal edges lying at the upper and lower edges of the basket assembly. The flanges 41 and 43 extend inwardly from the inside longitudinal edges of the side straps 40 and 42, respectively, superadjacent the upper edges of the heat transfer element plates 32. Similarly, the flanges 51 and 53 extend inwardly from the inside longitudinal edges of the side straps 50 and 52, respectively, subadjacent the lower edges of the heat transfer element plates 32. The upper flanges 40 and 42 and the lower flanges 50 and 52 provide retaining surfaces along the upper and lower edges of the basket assembly to prevent the heat transfer element plates 32 stacked therein from falling out of the open ends of the basket assembly 30 during transport handling, or installation. Additionally, one or more retaining bars 38 of a low height may be tack-welded between the end plates 34 and 36 at the open top and bottom of the element basket assembly 30 intermediate the side straps in order to further assist in preventing the heat transfer element plates 32 stacked therein from falling out the open ends of the basket element assembly 30.

In the present invention, a stiffening member 60 is disposed intermediate and parallel to the spaced end plates 34 and 36 to extend transversely across the element basket assembly in a plane through the centroid of the element basket assembly. The centroid of the element basket assembly as used herein means the center of mass of the assembled element basket assembly, i.e., that point in the assembled element basket assembly which moves as though the basket assembly's total assembled mass existed at that point. Given the trapezoidal geometry of the typical element basket assembly, the centroid will generally not lie mid-span between the spaced end plates 34 and 36, but rather somewhat off mid-span toward the end plate 36 at the larger end of the trapezoidal shaped basket 30. Once properly positioned the stiffening member 60 is welded at its lateral edges to the side straps 40, 42, 50 and 52 to structurally link the side straps thereby increasing the structure integrity of the frame of the element basket assembly 30.

Figure 4A:
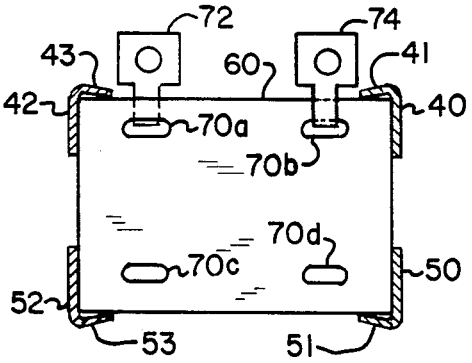
FIGS. 4*a* and 4*b* are cross-sectional elevation views taken along line 4—4 of FIG. 3 showing alternate embodiments of the element basket assembly.
Figure 4B:
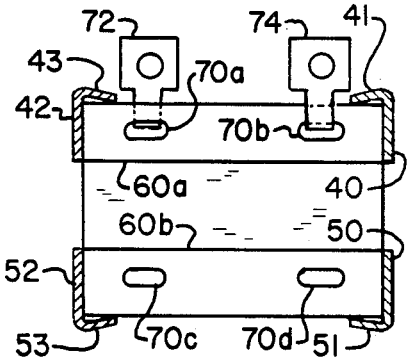

The stiffening member 60 may comprise a single plate similar to end plates 32 and 34 which extends from top to bottom and side to side across the entire cross-sectional area of the element basket assembly 30. The plate 60 is welded at each of its lateral edges to the upper side straps 40 and 42 and the lower side straps 50 and 52 as shown in FIG. 4*a* to structurally link the side straps. Alternatively, the stiffening member 60 may comprise a pair of spaced elongated plank-like members 60*a* and 60*b* which extend, respectively, across the upper region of the element basket assembly and across the lower region of the element basket assembly. As best seen in FIG. 4*b*, the member 60*a* is welded at its lateral edges to the upper side straps 40 and 42, and the member 60*b* is welded at its lateral edges to the lower side straps 50 and 52.

In either embodiment, the stiffening member 60 provides a cross-link interconnecting the upper side straps 40 and 42 and interconnecting the lower side straps 50 and 52 at or near the mid-span between the spaced end plates 32 and 34 of the element basket assembly 30 thereby increasing the structural integrity of the frame of the element basket assembly 30. As a result, not only is the weight capacity of the basket increased, but also rotational torsion of the side straps and lateral deformation of the basket frame are prevented.

In order to facilitate handling of the assembled element baskets 30, lifting means 70 are provided integral with the stiffening member 60 which is disposed in a plane parallel to the spaced end plates 34 and 36 and passing through the centroid of the element basket 30. As best seen in FIGS. 4*a* and 4*b*, the preferred lifting means 70 comprises a first pair of laterally spaced holes 70*a* and 70*b* formed integrally in an upper region of the stiffening member 60 and a second pair of laterally spaced holes 70*c* and 70*d* formed integrally in a lower region of the stiffening member 60. By providing lifting holes 70 in both an upper region and in a lower region of the stiffening member 60, the assembled element basket 30 may be lifted from either the top or the bottom thereby facilitating handling prior to installation.

The upper paired lifting holes 70*a* and 70*b* and the lower paired lifting holes 70*c* and 70*d* are integrally formed in the stiffening member 60 with the holes of each pair disposed on opposite sides of a vertical line passing through the centroid of the element basket assembly 30. One hole of each pair is spaced a predetermined desired distance to the right of the vertical line passing through the centroid, while the other hole of the pair is spaced the same predetermined desired distance to the left of that vertical line.

Figure 5:
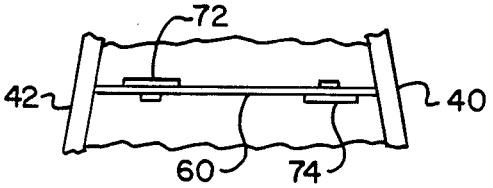
FIG. 5 is a plan view taken along line 5—5 of FIG. 4*a* showing the engagement of lifting hooks into the element basket assembly.

To lift an assembled element basket 30 from the heat exchanger 2 or to lower it into the heat exchanger 2, a first lifting hook 72 is inserted into the hole 70*a* from one side of the stiffening member 60 and a second lifting hook 74 is inserted into the hole 70*b* from the opposite side of the stiffening member 60 as illustrated in FIG. 5. The lifting hooks are designed to slip into the assembled element basket 30 in the spaces between the stiffening member 60 and the heat transfer element sheets 32 immediately adjacent the stiffening member 60.

Since the stiffening member 60, which is disposed in a plane passing through the centroid of the assembled element basket 30 and parallel to the spaced end plates 34 and 36, is itself the structural member supporting the basket 30 during lifting, and since the paired lifting holes 70*a* and 70*b* and 70*c* and 70*d* are disposed equally distant from the centroid of the assembled element basket 30, the element basket assembly 30 will remain horizontally and vertically stable during lifting, thereby simplying removal and installation of the assembled element baskets. Unless the element basket remains horizontally and vertically stable during lifting, the element basket will tilt and twist during removal or installation. As a result of such tilting or twisting, the element basket may hangup on other element baskets in the heat exchanger. With the element basket assembly of the present invention, the tendency of the element basket to twist and/or tilt during lifting is eliminated and the possibility of troublesome hangup greatly reduced.

It is to be understood that many configurations may be suitable for the stiffening member 60, other than the full plate or spaced plank-like member configurations specifically illustrated and discussed herein, so long as the stiffening member structurally interconnects the upper side straps 40 and 42, and also the lower side straps 50 and 52 and having integral lifting means formed therein as herein described.

While the heat transfer element basket assembly has been shown embodied in a rotary regenerative heat exchanger of the type wherein the mass of heat absorbent material is rotated alternately between the heating fluid and the fluid to be heated, it would be appreciated by those skilled in the art that the heat transfer element assembly of the present invention can be utilized in a number of other known heat exchange apparatus of either regenerative or recuperative type. Additionally, various stiffening member configurations, some of which have been alluded to herein, may be readily incorporated in the heat transfer basket assembly of the present invention by those skilled in the art. Therefore, it is intended by the appended claims to cover the modifications alluded to herein as well as all other modifications which fall within the true spirit and scope of the present invention as defined by said claims.

I claim:

1. An element basket assembly of the type adapted to be lifted by means of lifting hooks into and out of a heat exchanger, said element basket assembly having a mass centroid, said element basket assembly comprising:

a. a plurality of heat transfer element plates juxtaposed in a stacked array;

b. first and second end plate means disposed at opposite ends of said stacked array of heat transfer element plates in abutting relationship therewith;

c. a pair of spaced upper side straps disposed along opposite sides of said stacked array of heat transfer element plates interconnecting the upper edges of the sides of the first and second end plate means;

d. a pair of spaced lower side straps disposed along opposite sides of said stacked array of heat transfer element plates interconnecting the upper edges of the sides of the first and second end plate e. stiffening member means disposed within said stacked array of heat transfer element plates intermediate the first and second end plate means, said stiffening member means extending transversely across the element basket assembly in a plane through the mass centroid of the assembled element basket assembly to interconnect said pair of spaced upper side straps and to interconnect said pair of spaced lower side straps; and f. lifting means adapted to receive the lifting hooks for lifting the assembled element basket assembly, said lifting means comprising first and second paired lifting means formed integrally in said stiffening member means, said first pair of lifting means disposed in an upper region of said stiffening member means and said second pair of lifting means disposed in a lower region of said stiffening member means.

2. An element basket assembly as recited in claim 1 wherein said stiffening member means comprises a plate-like member extending from top to bottom and side to side across the cross-section of the element basket assembly.

3. An element basket assembly as recited in claim 1 wherein said stiffening member means comprises spaced upper and lower plank-like members, the upper member extending transversely across the element basket assembly interconnecting said pair of spaced upper side straps and the lower member extending transversely across the element basket assembly interconnecting said pair of spaced lower side straps.

4. An element basket assembly as recited in claim 1 wherein said lifting means comprises a first pair of laterally spaced holes, each adapted to receive a lifting hook, disposed in an upper region of said stiffening member means and a second pair of laterally spaced holes each adapted to receive a lifting hook, disposed in a lower region of said stiffening member means, the paired holes of each of said first and second pairs of lifting holes being disposed one on one side of and the other on the other side of a vertical line extending through the mass centroid of the assembled element basket assembly and spaced equally distant from said vertical line.

5. An element basket assembly as recited in claim 4 wherein said stiffening member means comprises a plate-like member extending from top to bottom and side to side across the cross-section of the element basket assembly.

6. An element basket assembly as recited in claim 4 wherein said stiffening member means comprises spaced upper and lower plank-like members, the upper member extending transversely across the element basket assembly interconnecting said pair of spaced upper side straps and the lower member extending transversely across the element basket assembly interconnecting said pair of spaced lower side straps.

* * * * *